US010131061B2

(12) United States Patent
Krans et al.

(10) Patent No.: US 10,131,061 B2
(45) Date of Patent: Nov. 20, 2018

(54) DEVICE AND SYSTEM FOR TREATING HAIR AND/OR SKIN

(71) Applicant: KONINKLIJKE PHILIPS N.V., Eindhoven (NL)

(72) Inventors: Jan Martijn Krans, Eindhoven (NL); Lucy Wade, Eindhoven (NL); Rufus Eugen Deodatus Driessen, Eindhoven (NL); Adrianus Johannes Maria Denissen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/893,727

(22) PCT Filed: May 12, 2014

(86) PCT No.: PCT/EP2014/059628
§ 371 (c)(1),
(2) Date: Nov. 24, 2015

(87) PCT Pub. No.: WO2014/191184
PCT Pub. Date: Dec. 4, 2014

(65) Prior Publication Data

US 2016/0107323 A1 Apr. 21, 2016

(30) Foreign Application Priority Data

May 30, 2013 (EP) ..... 13169857

(51) Int. Cl.
*B26B 19/38* (2006.01)
*B26B 19/40* (2006.01)
*B26B 21/40* (2006.01)

(52) U.S. Cl.
CPC ..... *B26B 19/388* (2013.01); *B26B 19/40* (2013.01); *B26B 21/4056* (2013.01)

(58) Field of Classification Search
CPC ... B26B 19/388; B26B 19/38; B26B 19/3873; B26B 21/40; B26B 21/4056
USPC ..... 30/32–84, 526–539, 194–221
See application file for complete search history.

(56) References Cited

U.S. PATENT DOCUMENTS 3,413,985 A * 12/1968 Dlouhy et al. ..... A45D 44/06 30/207
4,602,542 A * 7/1986 Natrasevschi ..... B26B 19/00 30/202
5,347,715 A 9/1994 Friedland
5,687,481 A * 11/1997 De Boer ..... B26B 19/14 30/43.1
5,970,831 A * 10/1999 Mattinger ..... B26B 19/40 30/41.7
6,009,623 A * 1/2000 Orloff ..... B26B 21/4056 30/41.7

(Continued)

FOREIGN PATENT DOCUMENTS

EP 1252980 A2 10/2002
FR 2699448 A1 * 6/1994 ..... B26B 19/46

(Continued)

*Primary Examiner* — Jason Daniel Prone

(57) ABSTRACT

The present application relates to a device for treating hair and/or skin. The device has a sensor (7) configured to detect an indicator on a user's hair and/or skin and a controller (8) operable to change an operating characteristic of the device in dependence on detection of the indicator.

14 Claims, 5 Drawing Sheets

(56) References Cited

U.S. PATENT DOCUMENTS 6,070,327 A * 6/2000 Taso ..... B26B 21/4081 30/34.2
6,176,166 B1 * 1/2001 Mattinger ..... B26B 19/40 30/41.7
6,553,680 B2 * 4/2003 Vazdi ..... A61B 5/107 33/286
8,082,927 B2 * 12/2011 Bonge ..... A45D 27/42 132/214
8,474,466 B2 * 7/2013 Lakin ..... B26B 19/00 132/214
8,627,573 B2 * 1/2014 Kraus ..... B26B 19/10 30/527
8,928,747 B2 * 1/2015 Burdoucci ..... A45D 44/005 348/61
9,126,346 B2 * 9/2015 Meier ..... A46B 5/0062 30/34.05
9,174,351 B2 * 11/2015 Binder ..... A45D 26/00 348/372
2001/0025421 A1 10/2001 Damstra
2004/0074511 A1 * 4/2004 Sussan ..... A45D 24/36 132/214
2004/0098862 A1 * 5/2004 Orloff ..... B26B 21/222 30/41.7
2006/0026841 A1 2/2006 Freund
2008/0033410 A1 2/2008 Rastegar
2008/0222906 A1 9/2008 Austin
2009/0000126 A1 * 1/2009 Kraus ..... B26B 19/046 30/34.1
2009/0049694 A1 * 2/2009 Morris ..... B26B 19/382 30/43.6
2009/0172948 A1 * 7/2009 Kitamura ..... A45D 27/46 30/41.6
2010/0064520 A1 * 3/2010 Park ..... B26B 19/06 30/42
2010/0186234 A1 * 7/2010 Binder ..... A45D 26/00 30/34.05
2011/0051892 A1 3/2011 Shafer
2011/0197726 A1 8/2011 Kraus
2012/0167392 A1 7/2012 Cherian
2012/0227554 A1 * 9/2012 Beech ..... B26B 19/382 30/34.05
2012/0317817 A1 * 12/2012 Binder ..... A45D 26/00 30/34.05
2012/0320180 A1 * 12/2012 Binder ..... A45D 26/00 30/34.05
2013/0227841 A1 * 9/2013 Solomon ..... A45D 26/00 30/34.05
2013/0250084 A1 * 9/2013 Binder ..... A45D 26/00 348/77
2013/0250122 A1 * 9/2013 Binder ..... A45D 26/00 348/162
2014/0102271 A1 * 4/2014 Krenik ..... B26B 19/3806 30/30
2014/0137714 A1 * 5/2014 Krenik ..... B26B 19/3806 83/13
2014/0137883 A1 * 5/2014 Rothschild ..... B26B 19/388 30/34.05
2014/0155754 A1 6/2014 Varghese
2014/0182138 A1 * 7/2014 Krenik ..... B26B 19/3806 30/123
2014/0320622 A1 * 10/2014 Binder ..... A45D 26/00 348/77
2015/0020658 A1 * 1/2015 Eljaouhari ..... B26B 19/388 30/34.05
2015/0040934 A1 * 2/2015 Krenik ..... A45D 24/36 132/214
2015/0059187 A1 * 3/2015 Krenik ..... B26B 19/42 30/200
2015/0128776 A1 * 5/2015 Zuidervaart ..... B26B 19/42 30/34.2
2015/0183118 A1 * 7/2015 Roth ..... B26B 19/384 30/34.05
2015/0197016 A1 * 7/2015 Krenik ..... B26B 19/3806 30/123
2015/0205279 A1 * 7/2015 Simeth ..... A45D 27/22 30/32
2015/0217465 A1 * 8/2015 Krenik ..... B26B 19/388 700/90
2015/0321365 A1 * 11/2015 Lauritsen ..... B26B 21/4081 83/75.5
2016/0001453 A1 * 1/2016 Binder ..... A45D 26/00 348/47
2016/0067872 A1 * 3/2016 Binder ..... A45D 26/00 348/55
2016/0167241 A1 * 6/2016 Goldfarb ..... B26B 21/4056 30/34.05
2016/0234465 A1 * 8/2016 Binder ..... A45D 26/00 348/61
2016/0236360 A1 * 8/2016 Veltman ..... B26B 19/388 30/43.6
2016/0257009 A1 * 9/2016 Godlieb ..... B26B 21/4081 83/13
2016/0262521 A1 * 9/2016 Kustra ..... A45D 24/36 348/46
2016/0263754 A1 * 9/2016 Lauritsen ..... B26B 19/388 83/75.5
2016/0263755 A1 * 9/2016 Uit De Bulten .... B26B 21/4081 83/75.5
2016/0297085 A1 * 10/2016 Uit De Bulten ..... B26B 19/388 83/13
2017/0043490 A1 * 2/2017 Uit De Bulten ..... B26B 19/388 83/76.2

FOREIGN PATENT DOCUMENTS

JP 7313749 A 12/1995
WO 0154869 A1 8/2001
WO 2006100627 A1 9/2006
WO 2013027142 A2 2/2013
WO WO 2014191184 A1 * 12/2014 ..... B26B 19/388
WO WO 2015068068 A1 * 5/2015 ..... B26B 19/388
WO WO 2015165935 A1 * 11/2015 ..... B26B 19/388

* cited by examiner

DEVICE AND SYSTEM FOR TREATING HAIR AND/OR SKIN

This application is the U.S. National Phase application under 35 U.S.C. § 371 of International Application No. PCT/EP2014/059628, filed on May 12, 2014, which claims the benefit of European Application No. 13169857.3 filed on May 30, 2013. These applications are hereby incorporated by reference herein.

FIELD OF THE INVENTION

This invention relates to a device and a system for treating hair and/or skin, particularly but not exclusively to a device and system for cutting hair.

BACKGROUND OF THE INVENTION

Devices for cutting hair includes powered hand-held devices that are placed against a user's skin and moved over areas where hair is to be cut. Such devices may include those that use an optical source to remove or sever hairs by photothermolysis, including intense pulsed light, laser beam and any other optical hair removal device and also includes any mechanical hair cutting devices. The user selects which areas of hair to cut and which areas should not be cut by positioning and moving the device appropriately.

Devices for treating hair may include those that treat hair by severing (including by photothermolysis and other optical methods), cutting, trimming, epilating, shaving, applying a substance (for example a colouring agent, shampoo or moisturiser) and others. Such devices are also typically powered hand-held devices and a user selects areas for treatment by positioning and moving the device in the appropriate manner. Similar devices may be used to treat skin, such as a device that applies a cream or other substance to a user's skin for any purpose including moisturising, artificial tanning or for applying a medical substance.

However, such devices are difficult to accurately position on the skin and it is difficult to only treat selected areas of skin and/or hair. The accuracy of the treatment provided by the device depends on the user's skill and steady hand. Moreover, the device and the user's hand and arm may impede the user's view thereby making it difficult to position and move the device accurately. For example, if a facial hair arrangement, such as a goatee beard, were desired then the user would have to position and move a hair cutting device around the shape of the goatee beard, which is difficult to perform and leads to inaccurate or undesired results.

SUMMARY OF THE INVENTION

It is an object of the invention to provide a device and a system for treating hair and/or skin which substantially alleviates or overcomes the problems mentioned above.

According to the present invention, there is provided a device for treating hair and/or skin comprising a sensor configured to detect an indicator on a user's hair and/or skin and a controller operable to change an operating characteristic of the device in dependence on detection of said indicator.

This device allows a user to select areas of their hair and/or skin for treatment prior to using the device by providing their hair and/or skin with an indicator which denotes selected areas of their hair and/or skin. The user can provide the indicator in any shape or pattern they desire and then use the device which will automatically adjust an operating characteristic of the device between areas of hair and/or skin with the indicator and areas of hair and/or skin without the indicator. Therefore, the problem of the user having to see and carefully control the exact position of the device is overcome because if the device is positioned incorrectly then the device will change an operating characteristic to avoid any undesired treatment.

The indicator may be a substance applied to a user's hair and/or skin.

A substance can be easily applied to hair and/or skin by using hands or any other apparatus, such as a pen, brush or a pre-formed stamp. The user can apply the substance to areas of their hair and/or skin where different treatment is desired and the device will recognise the substance as an indicator and change an operating characteristic of the device accordingly.

The device may further comprise a treatment head which is placed against said user's skin during use of the device, the treatment head comprising a treatment unit configured to treat hair and/or skin, wherein the controller is configured to change an operating characteristic of the treatment unit in dependence on detection of said indicator.

The treatment units provide the desired treatment to the hair and/or skin and by adjusting an operating characteristic of those treatment units the device can apply the desired treatment in the desired areas.

The controller may be configured to operate the treatment unit when the sensor detects said indicator.

In this way, the user would provide the indicator to areas of their hair and/or skin in areas where treatment is desired.

The controller may be configured to stop operation of the treatment unit when the sensor detects said indicator.

In this way, the user would provide the indicator to areas of their hair and/or skin in areas where treatment is not desired.

The treatment unit may comprise a cutting unit to cut hair when operated.

The device may be for cutting hair by means of shaving, trimming, epilating, or removing or severing hair by an optical method. For example, the device may remove or sever hairs by photothermolysis using intense pulsed light or a laser beam. Alternatively, the device may comprise any other means of cutting or severing hair. The operating characteristic changed by the controller will depend on the type of treatment being applied by the treatment unit.

The treatment head may comprise a guide face which is locatable against a user's skin during use of the device, the distance between the cutting unit and the guide face being adjustable, and wherein the controller is configured to adjust the distance between the cutting unit and the guide face in dependence on detection of said indicator.

In this way, the cutting of the hair can be stopped, by moving the cutting unit far enough away from the guide face to stop all treatment. Alternatively, the treatment being provided can be adjusted by changing the cutting height of the device. For example, if a user desired a goatee beard they may wish to shave the area of skin around the goatee beard and trim the hair of the goatee beard. Therefore, the user can provide an indicator to desired areas of their hair and/or skin and the device will adjust the cutting height accordingly.

The sensor may be configured to detect the hair and/or skin of a user which is adjacent to the treatment unit when the device is in use.

By detecting the hair and/or skin adjacent to the treatment unit the device is able to change the operating characteristic before the treatment unit treats that hair and/or skin with the indicator. Therefore, accurate and good quality treatment is provided.

The sensor may be configured to detect said indicator around at least a part of the periphery of the treatment unit.

Detecting the indicator around at least a part of the periphery of the treatment unit enables the device to be moved in various directions while still allowing the sensor to detect the indicator on the hair and/or skin before the treatment unit reaches that area. This allows the controller to adjust the operating characteristic of the device in time to provide good accuracy of treatment.

The sensor may extend along the periphery of the treatment unit.

Therefore, the device can be moved in various directions with the sensor disposed ahead of the treatment unit as the device moves across the skin of the user.

The sensor may comprise a wave guide and a sensor element.

The wave guide allows a single sensor to be used to detect the hair and/or skin around a part or the whole of the edge of the treatment head. Also, the wave guide provides continuous sensing capabilities across the length of the wave guide so any indicator can be detected by the sensor.

The treatment head may comprise two or more treatment units.

A plurality of treatment units will improve the effectiveness of the treatment provided by the device, which is also able to cover a larger area of hair and/or skin at any one time and conform to the contours of the skin more accurately.

The controller may be configured to change an operating characteristic of at least one of the two or more treatment units independently to the operating characteristic of the other treatment unit or at least one of the other treatment units in dependence on detection of said indicator.

Controlling the performance characteristic of each treatment unit independently allows more accurate treatment in the vicinity of a boundary between an area of hair and/or skin to with the indicator and an area of hair and/or skin without the indicator. Furthermore, the effectiveness of the treatment in that region is also improved as some of the treatment units will continue to provide treatment even if the performance characteristic of some other treatment units has been changed due to detection of the indicator.

The device may comprise a plurality of sensors disposed to detect said indicator on said user's hair and/or skin.

At least two of the plurality of sensors may be arranged around the periphery of the treatment unit, such that the sensors are arranged to detect the hair and/or skin of a user which is adjacent to the treatment unit in a plurality of directions when the device is in use.

If the device has a plurality of sensors then the detection of the indicator on the hair and/or skin is more accurate and a larger treatment head with more or larger treatment units can be provided without sacrificing the accuracy or effectiveness of the device.

Moreover, a sensor may be configured to detect the user's hair and/or skin in an area between two treatment units. This would allow more accurate cutting and enable the controller to detect variations in the boundary between areas of skin with the indicator and areas of hair and/or skin without the indicator, which may be undetected by sensors configured to detect hair and/or skin around the edges of the treatment unit.

The device may further comprise a feedback unit, wherein the controller is configured to change an operating characteristic of the feedback unit when the sensor detects said indicator.

The feedback unit informs the user when the indicator has been detected and this may be via an audible sound, a tactile signal such as a vibration or other movement, or by an optical signal such as a flashing light. Alternatively, any operating characteristic of the feedback unit may be changed to inform the user accordingly. The user is then able to take appropriate action to achieve the desired treatment.

According to the present invention, there is also provided a system for treating hair and/or skin comprising a device for treating hair and/or skin according to any preceding claim and apparatus for providing a user's hair and/or skin with an indicator which is detectable by the sensor of the device.

The sensor or sensors may be configured to detect a substance visible in the ultraviolet spectrum of light, so that an ultraviolet substance can be applied to a user's hair and/or skin for use of the device. The substance may or may not be visible in normal light conditions so once the treatment process is completed the substance remaining on the hair and/or skin of the user may be invisible or may need to be washed off.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
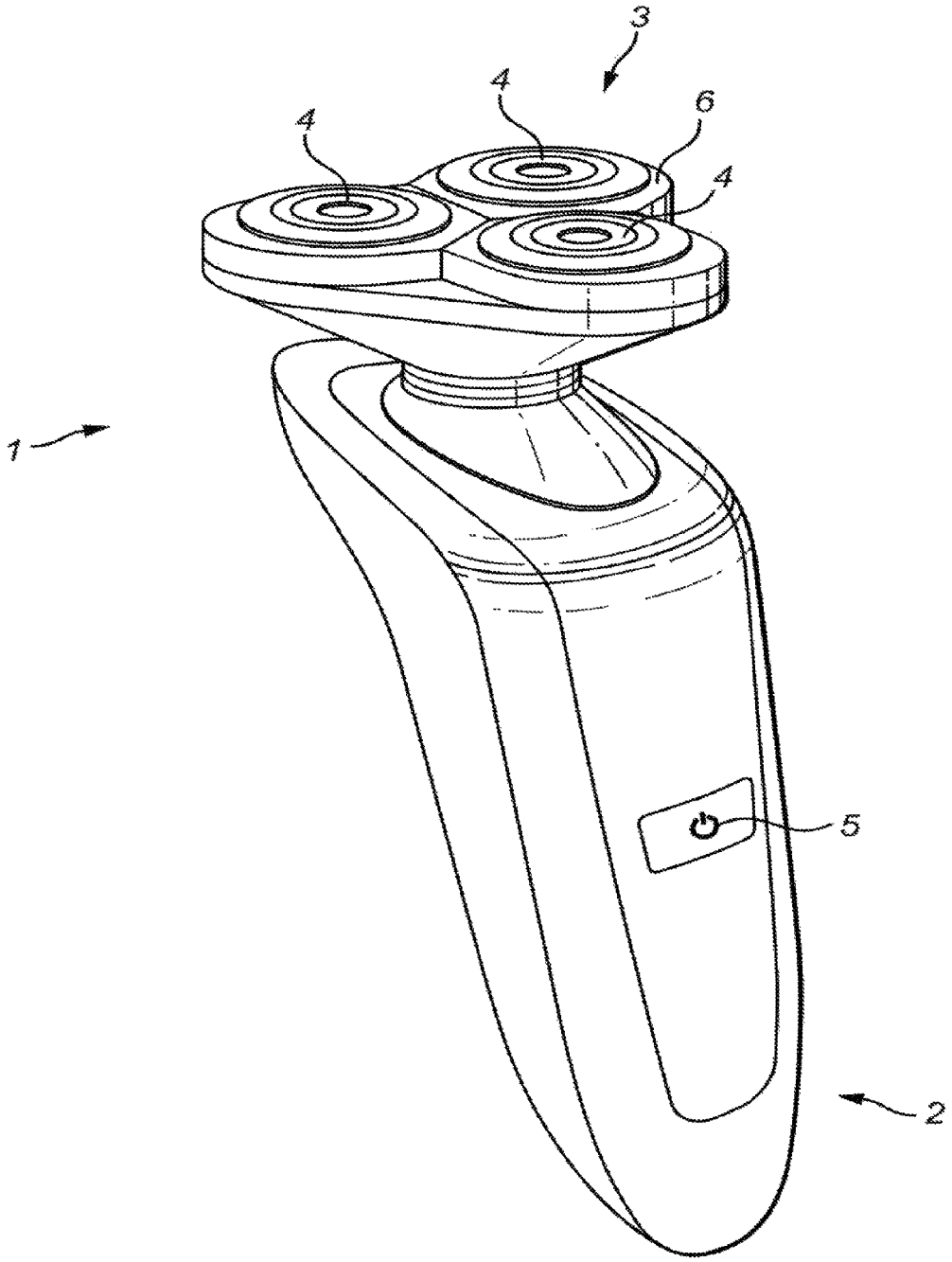
FIG. 1 shows a device for cutting hair.

FIG. 1 shows a device for cutting hair, in particular a hand-held electrical shaving device 1 that is moved over areas of skin by a user to shave hair. The device 1 comprises a handle portion 2 and a cutting head 3 arranged so that the handle portion 2 can be held by a user and the cutting head 3 comprises at least one cutting unit 4 which is placed against the skin of a user during use. In this example, the cutting head 3 has three cutting units 4 although it will be appreciated that this is merely an example and such a device may have any number of cutting units 4. Each cutting unit 4 has cooperating mechanical cutting parts (not shown) in the form of a foil or element(s) which is placed against the skin and past which the hairs protrude, and a rotating blade arranged to cut the hairs against an edge of the foil. However, it will be appreciated that some other example devices for cutting hair have a foil through which hairs protrude and a cutting blade which moves linearly relative to the foil to cut hairs.

The device 1 shown in FIG. 1 comprises a power supply and an actuator, such as an electric motor, to drive the cutting units 4. The power supply may comprise an in-built battery or a power cord that connects the device to an external electricity source. The device 1 also comprises a controller and some form of user interface 5, such as a button or switch, for switching the device on and off. Optionally, the device 1 may include additional controls and/or displays for adjusting some operating characteristic of the device, such as the power or cutting height of the cutting units 4, and informing the user about a current state of the device. In this example, the handle portion 2 and the cutting head 3 of the device 1 are distinct and are moveably mounted to each other. In particular, the treatment head 3 is pivotally mounted to the handle portion 2 for rotation about a ball-and-socket type joint so that the cutting head 3 can rotate in all directions relative to the handle portion 2, to follow the contours of the user's skin. However, it will be appreciated that the cutting head 3 may be mounted to the handle portion 2 in any other way, such as for rotation about one or two fixed axes or the cutting head 3 may be fixedly mounted to the handle portion 2. In some embodiments, the handle portion 2 and cutting head 3 may be integrally formed.

The device 1 of FIG. 1 is operated by placing a guide face 6 of the cutting head 3 against the skin and moving the device 1 over areas of hair to be cut. The guide face 6 of the cutting head 3 is placed flat against the skin and hairs being received in the cutting units 4 are cut. For example, for shaving skin in a certain area, the user moves the device 1 over the skin to be shaved and avoids moving the device 1 over skin where shaving is not desired. Therefore, a user can select what areas to shave and leave some areas unshaven. For example, when a goatee beard, shaped sideburns or other facial hair arrangement is desired the user can move the device 1 around the goatee beard, only shaving areas where no hair is desired. The hair being cut as the device 1 is moved over the skin will depend on the size and shape of the guide face 6 of the cutting head 3 which is placed against the skin and also on the size, shape and arrangement of the cutting units 4 on the guide face 6.

However, the extent of the cutting action of the device is difficult to predict and control and the user relies on their skill and steady hand to move the device in the appropriate manner. This can be difficult when holding the device 1 against the skin as any undue movement of the skin or hand may cause a mistake. Furthermore, the device 1 and/or the hand or arm of the user may obstruct the view of the user when the device 1 is in use and this may result in the device being moved in an undesired manner and cause inaccuracies or mistakes. Therefore, it is difficult to use such a device to achieve accurate cutting of hairs, for example if a distinct facial hair arrangement is desired.

The invention as defined in the claims provides a device for treating hair and/or skin, including cutting hair, which allows a user to demarcate areas of their hair and/or skin for treatment by applying a substance to, or around, those selected areas. The user applies the substance to their hair and/or skin and a device of the invention is configured to detect that substance and adjust an operating characteristic of the device accordingly.

Figure 2:
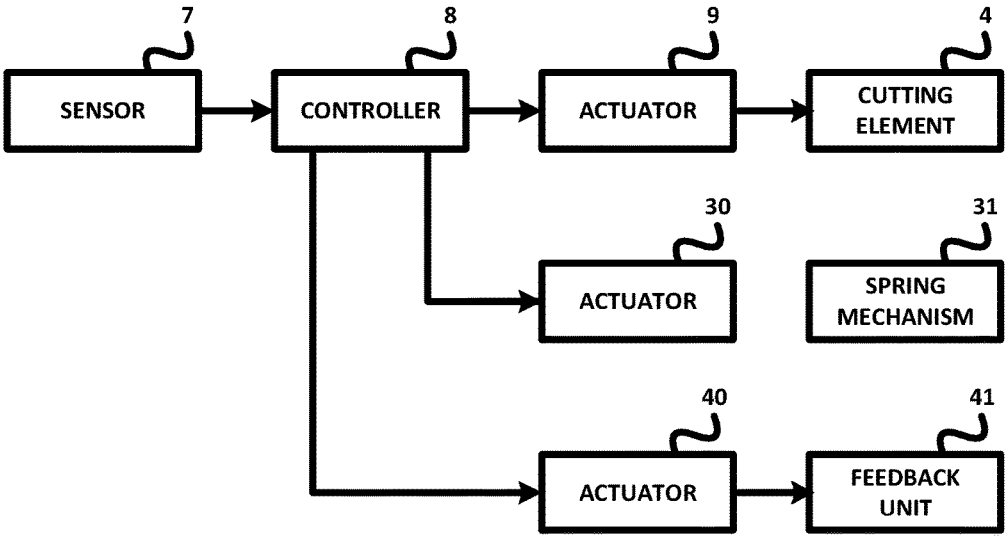
FIG. 2 shows a process diagram for a device of the invention having a sensor and a controller.

FIG. 2 shows a diagram of components of a device of the invention. The device comprises a controller 8 which controls an actuator 9 which in turn drives a powered cutting unit 4. The device also comprises a sensor 7 which is disposed to detect a substance applied to the hair and/or skin of a user during use.

The sensor 7 communicates with the controller 8 to inform the controller 8 when the substance applied to the hair and/or skin is detected and the controller 8 is configured to adjust an operating characteristic of the device in response to the detection or non-detection of the substance on the hair and/or skin. In this example, the controller 8 is configured to adjust an operating characteristic of the actuator 9 and therefore the cutting unit 4 in dependence on the detection of the substance. By further example, the controller 8 may be configured to control an actuator 30 for adjusting a cutting height of the cutting unit 4 or alternatively a spring mechanism 31 may be provided to adjust a cutting height of the cutting unit 4. Also, by example, the controller 8 may be configured to control an actuator 40 for activating or deactivating a feedback unit 41.

Figure 3:
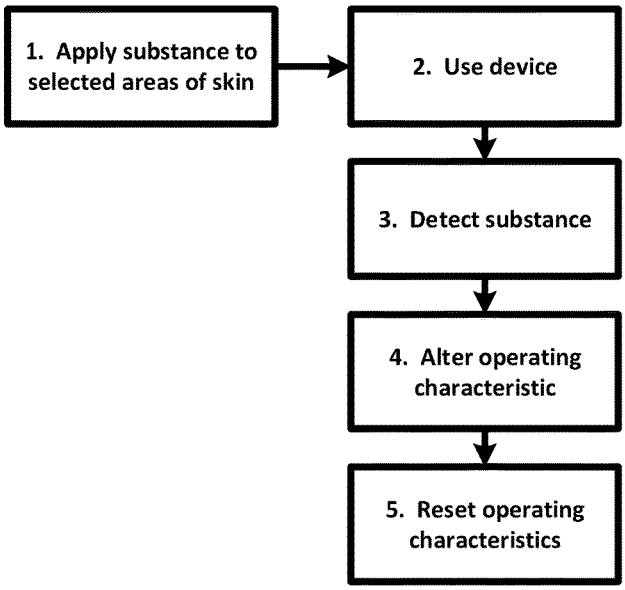
FIG. 3 shows a method diagram for use of the device of FIG. 2.

FIG. 3 shows a method diagram showing how the device described with reference to FIG. 2 is to be used. The method comprises the initial step of a user applying a substance to selected areas of hair and/or skin. The selected areas of hair and/or skin to which the substance is applied relate to areas where treatment is either desired or not desired. Alternatively, the substance may be applied to demarcate a border around areas of the hair and or/skin where treatment is either desired or not desired. In any case, the substance applied to the hair and/or skin will demarcate a boundary between areas where different treatment is desired. It will be appreciated that in applying a substance to the surface of a user's skin the substance will be provided to both the skin and any hairs that are on that area of skin. Therefore, the substance will inevitably be applied to both the skin and any hair on that skin, whether the device is for treating the hair or the skin or both.

Secondly, the user places the device on their skin and moves the device over the skin in a manner similar to that described with reference to the device of FIG. 1. Thirdly, as the device is moved over the skin a sensor on the device is configured to detect the presence of the substance on the user's hair and/or skin and communicate that detection with the controller. Fourthly, the controller is configured to adjust or alter an operating characteristic of the device such that the hair and/or skin is treated in a different manner in areas where the substance has been applied. The method may also include a fifth step of resetting the operating characteristic of the device after a fixed time period, once the device has been moved back to an appropriate area or once a user has manually reset the device.

Specifically, as shown in FIG. 3, the method includes the steps of:

applying a substance to the hair and/or skin to demarcate areas for different treatment;

using the device by positioning it against the skin and moving it across the surface of the skin;

detecting the substance that has been applied to the user's hair and/or skin;

altering an operating characteristic of the device in dependence on the detection or non-detection of that substance; and, resetting the operating characteristic of the device at an appropriate time.

The third step of the method described with reference to FIG. 2 includes sensing whether the hair and/or skin have a substance applied to them and the fourth step includes altering an operating characteristic of the device based on whether or not a sensor of the device detects the substance.

Therefore, the operating characteristic of the device is controlled in dependence on the detection or non-detection of the substance on the hair and/or skin of the user.

Referring to both FIG. 2 and FIG. 3, the sensor 7 and controller 8 of the device may be configured to determine when the device is positioned on areas of hair and/or skin to which the substance has been applied and alter an operating characteristic accordingly. Alternatively, the sensor 7 and controller 8 of the device may be configured to alter an operating characteristic of the device when the device is positioned on hair and/or skin that has not been provided with the substance. That is, normal operation of the device may occur either when the sensor 7 does not detect the substance, or when the sensor 7 does detect the substance. Alternatively, the sensor 7 and controller 8 may be configured to detect a line of substance which has been applied to the hair and/or skin to demarcate an area of hair and/or skin where treatment is or is not desired. In this case, the controller 8 changes an operating characteristic of the device when the device is moved across that line of substance on the hair and/or skin.

The operating characteristic that is altered in dependence on the detection or non-detection of the substance will depend on the purpose and function of the device. For example, if the device is a shaving device, as described with reference to FIG. 2, the method may include altering the operating of the device so that it does not cut hairs. For example, the actuator 9 that drives the cutting unit 4 of the device may be disabled. Alternatively, a part of the cutting unit 4 may be moved to prevent cutting or severing of the hairs or to change the cutting height of the cutting unit 4. For example, an actuator or spring mechanism could move a cutting blade away from a counterpart cutting unit, or a light based hair cutting device may be stopped by disabling the light source.

Similarly, if the device is not a hair severing device, but instead any other device for treating hair and/or skin, the treatment can be stopped or started depending on whether or not the sensor detects the substance applied to the hair and/or skin.

The fifth step of the method shown in FIG. 3 is to reset the operating characteristic of the device. This may be an automatic process performed by the controller 8 or it may be a manual process performed by the user. For example, the controller 8 may be configured to reset the operating characteristic after a predetermined fixed period of time has elapsed, so that the user has time to move the device into an appropriate position before the treatment is continued. Alternatively or additionally, the controller may be configured to reset the treatment process once the sensor 7 no longer detects the substance on the hair and/or skin. This may occur when the user moves the device away from the skin, thereby resetting the device before placing the device back on the skin to continue treatment. If the step of resetting the operating characteristic of the device is a manual process, the device may be provided with a button or a switch which can be used to reset the device.

Figure 4:
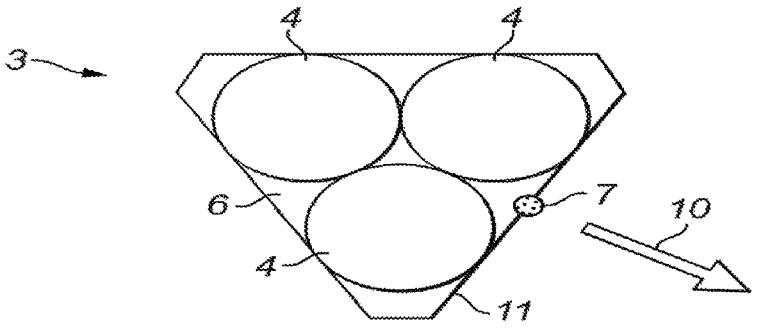
FIG. 4 shows an end view of a cutting head of a device for cutting hair, having a sensor.

FIG. 4 shows an end view of the cutting head 3 of an example of a device for shaving hair as described with reference to FIG. 2 and for use in the method described with reference to FIG. 3. As shown, the cutting head 3 has three cutting units 4 arranged in a triangular shape which defines a cutting area on the guide face 6 of the cutting head 3 which is placed against the user's skin during use, similar to the device 1 described with reference to FIG. 1.

As shown in FIG. 4, a sensor 7 is disposed on the cutting head 3 and is arranged to detect, while the device is in use, the presence of a substance applied to the hair and/or skin of a user. The sensor 7 is positioned adjacent to an edge 11 of the cutting head 3 so that as the device is moved across the skin in the direction of arrow 10 the sensor 7 is ahead of the cutting units 4 and able to detect the substance applied to the hair and/or skin before the cutting units 4 reach that area. Therefore, when the sensor 7 detects the substance which has been applied to the hair and/or skin, the controller can alter an operating characteristic of the cutting units 4 before they reach that area. For example, the cutting units 4 may be deactivated by turning off the actuator or by moving the cutting blades away from their cooperating cutting parts.

Figure 5:
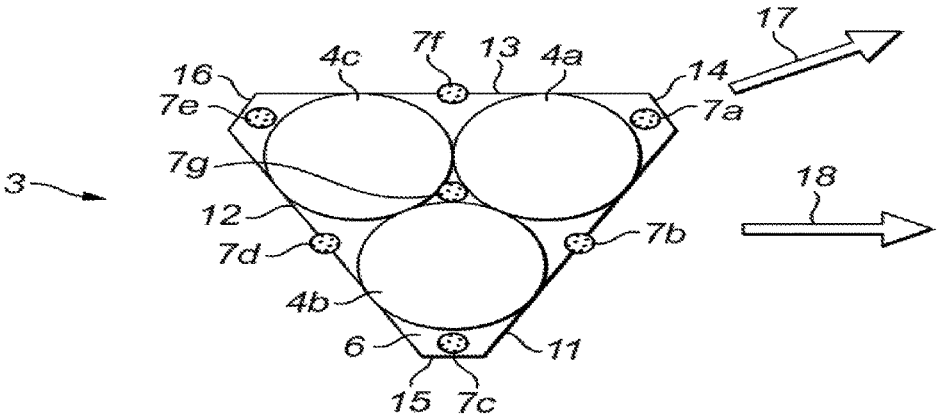
FIG. 5 shows an end view of a cutting head of a device for cutting hair, having multiple sensors.

FIG. 5 shows an end view of the cutting head 3 of another example of a device for shaving hair as described with reference to FIG. 2 and for use in the method of FIG. 3. In this example, the cutting head 3 is provided with a plurality of sensors 7*a*-7*f* arranged around the edges 11, 12, 13 of the cutting head 3 to form a boundary around the cutting units 4*a*-4*c*. In this way, the device can be moved across the skin in any direction and as the device approaches an area of hair and/or skin to which the substance has been applied at least one of the sensors 7*a*-7*f* will detect the substance before the cutting units 4*a*-4*c* reach that area and the controller will adjust an operating characteristic of the cutting units accordingly.

Specifically, the example device shown in FIG. 5 has a generally triangular cutting head 3 with three cutting units 4*a*-4*c* arranged in a triangle. Sensors 7*b*, 7*d*, 7*f* are positioned at the mid-point of each side 11, 12, 13 of the triangular cutting head 3 and sensors 7*a*, 7*c*, 7*e* are positioned at the corners 14, 15, 16 of the triangular cutting head 3 so that the device can be moved in any direction across the skin and the substance will be detected before the cutting units 4*a*-4*c* reach the area of hair and/or skin to which the substance has been applied.

In one example, the controller may respond to the detection of the substance on the hair and/or skin by any of the plurality of sensors 7*a*-7*f* by adjusting the operating characteristics of all of the cutting units 4*a*-4*c*, for example by deactivating them. Alternatively, the controller may be configured to control each of the cutting units 4*a*-4*c* independently and only adjust the operating characteristic of a cutting unit 4 when a sensor detects the substance in the vicinity of that cutting unit 4.

For example, if the device were moving in the direction of arrow 17 then the sensor 7*a* disposed on the leading corner 14 of the cutting head 3 may detect the substance on the hair and/or skin first and the cutting unit 4*a* closest to that sensor 7*a* may be deactivated while the other cutting units 4*b*, 4*c* remain in operation. Subsequently, if the device continues to move in the direction of arrow 17, then once the sensors 7*b*, 7*f* disposed on the mid-points of the sides 11, 13 of the cutting head 3 also detect the substance the remaining cutting units 4*b*, 4*c* can be deactivated.

In another example, the device may be moving in the direction of arrow 18 and in this case the sensor 7*a* disposed at the leading corner 14 of the device will detect the substance first and cutting unit 4*a* will be deactivated. If the device continues to be moved in the direction of arrow 18 then once sensor 7*b* detects the substance the second cutting unit 4*b* is deactivated and subsequently once sensors 7*c*, 7*f* detect the substance on the hair and/or skin then the last cutting unit 4*c* is also deactivated.

By independently controlling the cutting units 4*a*-4*c* in response to detection of the substance on the hair and/or skin by the plurality of sensors 7*a*-7*f* the cutting accuracy and resolution of the device will be improved. This is because the device is able to continue cutting in the region of the boundary of the demarked areas of hair and/or skin even if some of the cutting head 3 and cutting units 4*a*-4*c* are over the boundary and therefore deactivated. This will reduce the distance between the boundary of the substance and the extent of the cutting action and therefore improve cutting accuracy and cutting effectiveness in the region of the boundary between hair and/or skin with substance and hair and/or skin without substance.

As shown in FIG. 5, the device may also include a further sensor 7*g* disposed between the cutting units 4*a*-4*c*, in the area within the boundary of sensors 7*a*-7*f* arranged around the cutting head 3 of the device. This will further improve the accuracy of the cutting action and improve the resolution of the device. Moreover, this additional sensor 7*g* will help to account for non-linear edges of demarcated areas. That is, if the boundary between areas of hair and/or skin with and without the substance is not straight then the additional sensor 7*g* helps to improve the accuracy of the cutting.

In an alternative example not shown in the Figures, a device for cutting hair may be provided with two or more cutting units arranged linearly with sensors arranged linearly along at least one side of the cutting units. For example, a plurality of sensors may be arranged around all four sides of the linear arrangement of the cutting units so that the device can be moved in any direction. If the cutting units are arranged to cut hair when moving in any direction across the skin then sensors may be arranged around all sides of the cutting units to detect the hair and/or skin. However, if the cutting units only cut hair when moving in one or two fixed directions then the sensors may be positioned to detect the hair and/or skin adjacent to the cutting units in those directions, so that the controller is able to adjust an operating characteristic of the device when the substance is detected on the hair and/or skin immediately ahead of the cutting unit(s) being moved across the skin.

In this way, the sensors are disposed around the cutting units in a similar manner to the device described with reference to FIG. 5 and will detect a substance applied to the hair and/or skin of the user before the cutting units reach that hair and/or skin, so that the controller is able to adjust an operating characteristic of the device to cut the hairs as desired.

The device described with reference to FIG. 5 and above may additionally comprise a motion sensor, such as an accelerometer, which is configured to detect in which direction the device is moving over the skin of the user. Therefore, the controller will be able to determine which sensor or sensors should be the first to detect the presence of the substance on the hair and/or skin and the controller will be able to more quickly and more accurately determine when the cutting action of the device should be altered. For example, if the device were being moved in the direction of arrow 18, as shown in FIG. 5, the controller will determine that sensors 7*a*, 7*b* and 7*c* will detect any substance applied to the skin before the other sensors 7*d*, 7*e*, 7*f*, 7*g* and may use the signals from only these sensors 7*a*, 7*b* and 7*c* to alter the cutting action of the device. In this way, mistaken detection of the substance by one or more of the other sensors 7*d*, 7*e*, 7*f*, 7*g* may be disregarded and cutting accuracy can be improved.

Figure 6:
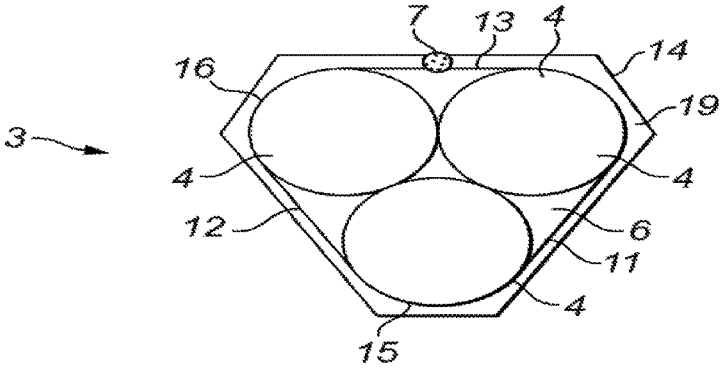
FIG. 6 shows an end view of a cutting head of a device for cutting hair, having a wave guide.

FIG. 6 shows an end view of the cutting head 3 of another example of a device for shaving hair as described with reference to FIG. 2 and for use in the method of FIG. 3. In this example, the device is provided with a single sensor 7 and a wave guide 19 that extends around the edges 11, 12, 13 and corners 14, 15, 16 of the cutting head 3 and to which the sensor 7 is mounted such that the sensor 7 is able to detect the substance on areas of hair and/or skin adjacent to any part of the wave guide 19. In this example, the substance applied to the hair and/or skin is optically detectable and the sensor 7 is an optical sensor. Therefore, when the device is moved over the skin and the wave guide 19 moves over an area of hair and/or skin to which the substance is applied the sensor 7 will be able to detect the substance via light waves which travel from the substance, into the wave guide 19 and through the wave guide 19 to the sensor 7. Therefore, a single sensor 7 can detect the substance on any edge of the cutting head 3.

In the example shown in FIG. 6 the sensor 7 is positioned on an edge 13 of the cutting head 3 and a single wave guide 19 extends around each of the edges 11, 12, 13 and corners 14, 15, 16 of the treatment head 3. However, it will be appreciated that the sensor 7 may be positioned elsewhere on the treatment head 3, for example centrally between the cutting units 4, with the wave guide 19 extending to coincide with the sensor 7. It will also be appreciated that the wave guide 19 may not extend around all of the edges 11, 12, 13 and corners 14, 15, 16 of the treatment head 3 and may instead only extend around one or possibly two edges. For example, if the device is designed to be used in a particular orientation the wave guide 19 need only extend across the leading edge of that device. Also, the cutting head 3 of a device may be provided with multiple wave guides, each having a single sensor. For example, a sensor and a wave guide may be disposed on each of the three edges 11, 12, 13 of the generally triangular cutting head 3 shown in FIG. 6.

The wave guide 19 allows the device of FIG. 6 to be moved over the skin in any direction and the sensor 7 is able to detect when the wave guide 19 moves over hair and/or skin to which the substance has been applied. Therefore, fewer sensors are required.

Figure 7:
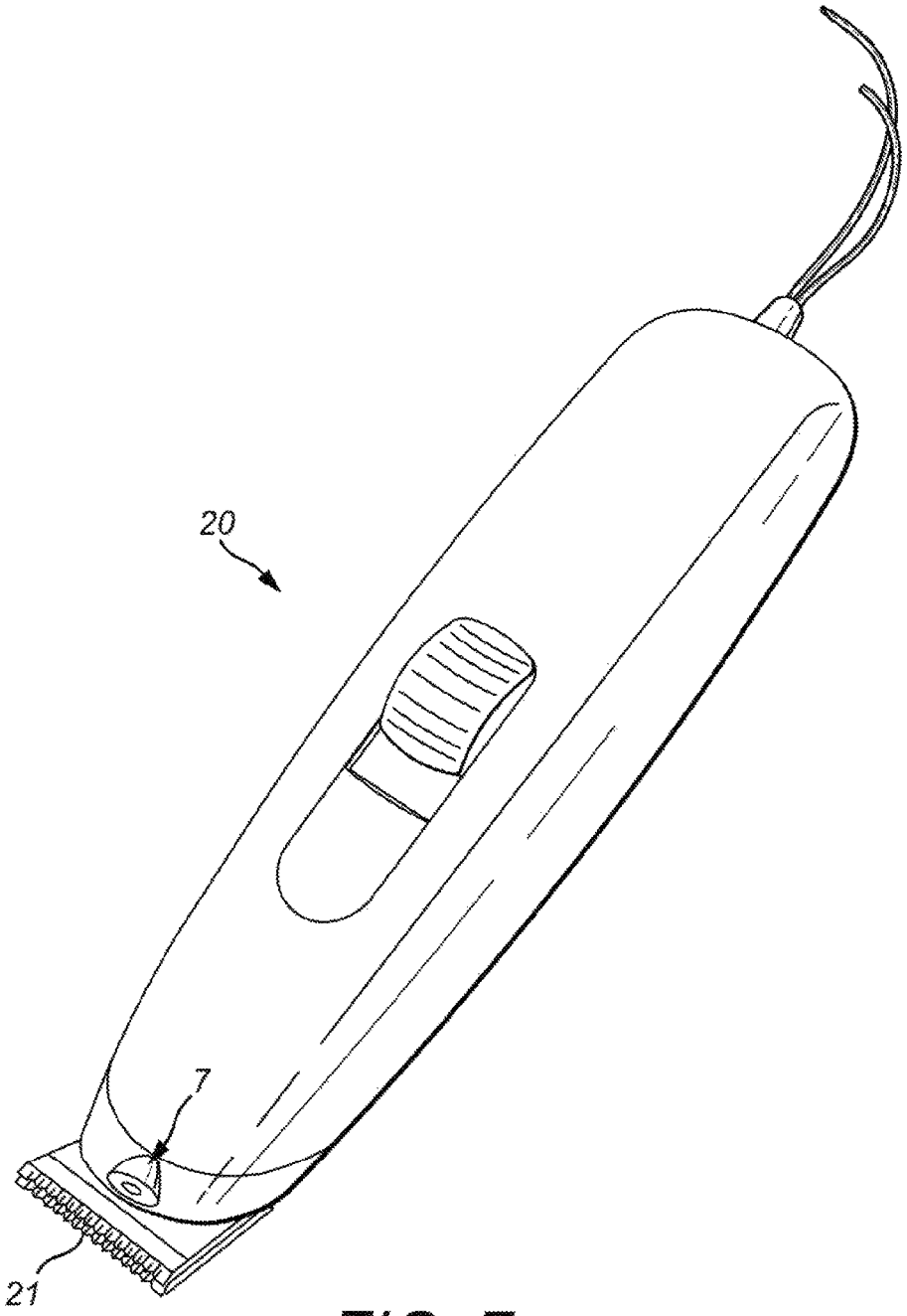
FIG. 7 shows a device for trimming hair having a sensor.

FIG. 7 shows an example of a device 20 for cutting or trimming hair with a sensor 7 to detect a substance applied to a user's hair and/or skin, in accordance with the device described with reference to FIG. 2 and the method described with reference to FIG. 3. This device comprises a linear row of mechanical cutting blades 21 and a sensor 7 mounted on one side of the row of cutting blades 21. The device 20 of this example, similarly to other devices for cutting hair, works when moved across the skin with the blades in an orientation which is perpendicular to the direction of movement. Therefore, there are only one or two possible directions of movement of the device 20 and fewer sensors 7 are required to detect the substance applied to areas of the hair and/or skin before the cutting blades 21 reach those areas. However, it will be appreciated that the a device similar to that shown in FIG. 7 may comprise more than one cutting unit, for example two cutting units located side-by-side. In this case, more sensors may be provided to detect the substance applied to the hair and/or skin for each cutting element.

In this example, the sensor 7 is positioned adjacent to the cutting blades 21 so that as the device 20 is moved over the skin the sensor 7 is disposed ahead of the cutting blades 21 and is able to detect when the device 21 is moving over an area of hair and/or skin with the substance applied to it and adjust the operating characteristic of the device accordingly. In another example not shown in the drawings, sensors may be positioned on either side of the cutting blades, so that the device works when moving in either direction with the cutting blades perpendicular to the direction of movement. In yet another example, a device similar to that of FIG. 7 may be provided with two sensors on the same side of the cutting blades, positioned at either end of the cutting blades. This will improve the resolution and accuracy of the cutting action and allow the device to cut hairs more closely and accurately against the boundary between areas of hair and/or skin with the substance and areas of the hair and/or skin without the substance.

In an alternative embodiment not shown in the Figures, the controller does not adjust the performance of an actuator in dependence on detection of the substance, but rather informs the user of the device via a feedback unit. For example, if the sensor detects the substance while the device is in use the controller will alter an operating characteristic of the feedback unit to inform the user of the detection of the substance on the hair and/or skin of the user so that they can take the appropriate action. The feedback unit may provide an acoustic signal, in the form of an audible sound such as a beeping sound. Alternatively, the feedback unit may provide tactile feedback in the form of vibrations that are felt by the user via the handle of the device. Alternatively, the feedback unit may provide an optical signal, such as flashing light or other optical indicator. It will be appreciated that the feedback unit may also provide more than one of the above mentioned signals in response to detection, or non-detection, of the substance on the hair and/or skin of the user.

It will be appreciated that the sensor, sensors and/or the wave guide described with reference to any of FIGS. 2 to 7 may not be mounted to the cutting head of the device and may alternatively be mounted to other parts of the device, for example a handle portion or a specially adapted sensor mounting part.

The hair cutting or shaving devices described with reference to FIGS. 2 to 7 each have a treatment head which is placed against the skin of a user during use. However, it will be appreciated that other parts of the device may alternatively be placed against the skin of a user during use, for example the device may be provided with a comb attachment or similar. Alternatively, the device may not be placed directly against the skin of the user, for example the device may operate close to the skin without actually contacting the skin. Therefore, the sensors may be disposed in another part of the device which is closer to or placed against the skin of the user during use and not necessarily the treatment head of the device. Therefore, the sensor(s) may be configured to detect the substance applied to the hair and/or skin of the user at close range or alternatively from a greater distance. The sensors may include some focussing element or magnification element to allow the sensor to detect the substance on the hair and/or skin of the user from a distance.

It will also be appreciated that the user may apply the substance to their hair and/or skin to cover all areas that should or should not be treated and the controller will change the operating characteristic of the device based on whether the substance is or is not detected. Alternatively, the user may apply the substance to their hair and/or skin in the form of lines around the area to be treated, or lines around the area not to be treated, and the controller can be configured such that when the device is moved over the line an operating characteristic is adjusted accordingly. The controller may be fixed in one of these configurations or may comprise a user-changeable setting to switch the configuration of the controller between the options described above.

In the examples described with reference to FIGS. 2 to 7, the substance applied to the hair and/or skin may be ultraviolet ink and the sensor may be an ultraviolet light sensor. The ultraviolet light sensor may detect ultraviolet light reflected by the substance applied to the hair and/or skin. In some embodiments, the substance may be a fluorescent substance that is both detectable by an ultraviolet light sensor and visible to the user under normal light conditions. In some embodiments, the ultraviolet light sensor may comprise an ultraviolet light source, so that detection of the ultraviolet substance is not dependent on background light in the ultraviolet spectrum being incident on the hair and/or skin during use. When using a waveguide, as described with reference to FIG. 6, together with a light source, a first part of the waveguide may provide light that illuminates the hair and/or skin and a second part may be connected to the sensor to carry reflected light back to the sensor. Alternatively, the sensor may rely on background ultraviolet light which is reflected by the substance on the hair and/or skin and detected by the ultraviolet light sensor.

The example described above relates to an ultraviolet substance being applied to the hair and/or skin of the user prior to use of the device. However, it will be appreciated that other substances may alternatively be applied to the hair and/or skin and appropriate sensors provided to detect the presence of this substance on the hair and/or skin of the user. For example, the substance may be any substance which is optically detectable, within the visible spectrum or otherwise. Examples of other optically detectable substances that may be applied to the hair and/or skin include a graphite substance or make-up or any other easily applicable and visible or invisible substance.

However, it will be appreciated that the substance applied to the hair and/or skin may not be optically detectable and may instead have some other feature which the sensor is configured to detect. For example, the substance may alter the electrical conductance or mechanical acoustics of the skin. An example of a substance that alters electrical conductance might be an electrolyte substance, such as a soluble salt, and the presence of this substance can be detected by a sensor having electrodes that measure conductance and identify when the conductance changes significantly as the device is moving over the skin, thereby identifying the boundary between skin without the substance and skin with the substance and enabling the controller to change an operating characteristic appropriately. An example of a substance that alters the mechanical acoustics of the skin may be a substance that solidifies once it is applied to the skin and this may be detected by a sensor having a probe which determines differences in the acoustic properties of the skin.

Alternatively, the substance applied to the hair and/or skin may be a specific chemical substance and the sensor may be configured to detect the presence of that specific chemical substance and enable the controller to change an operating characteristic of the device appropriately.

Figure 8:
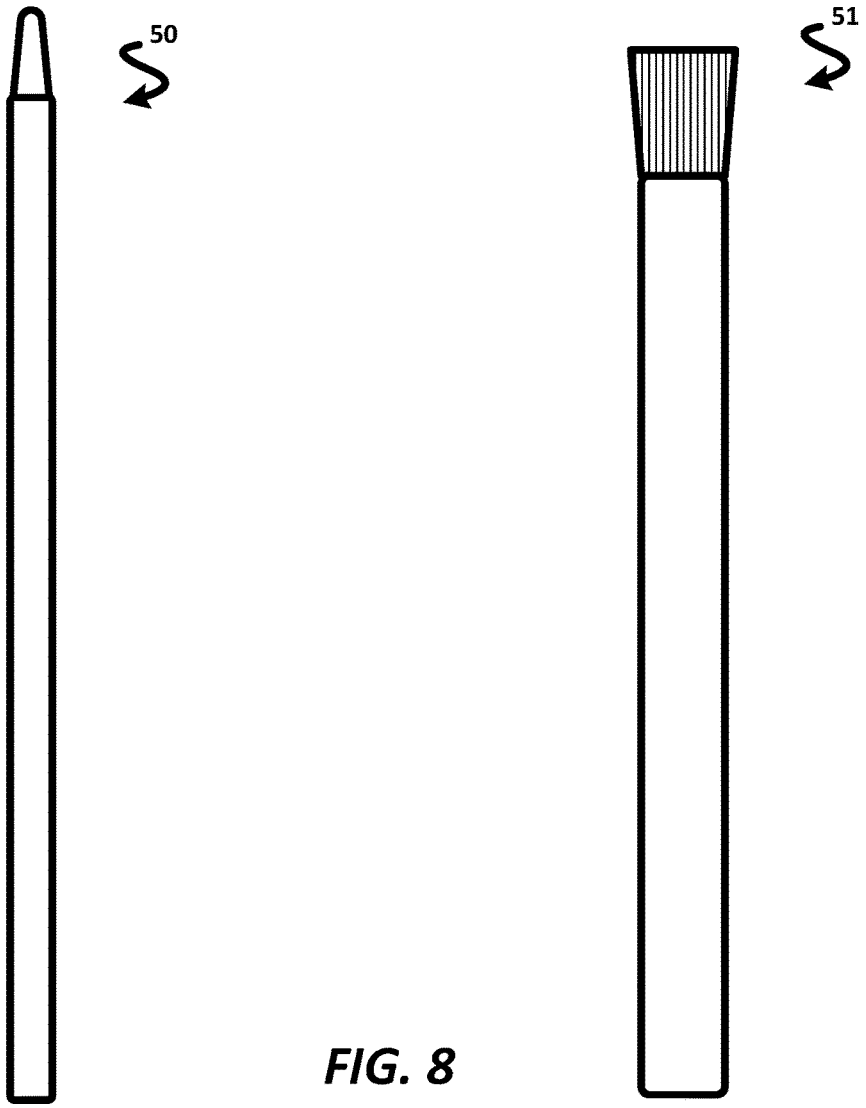
FIG. 8 (PRIOR ART)
FIG. 8 shows a pen and a brush for applying a substance to a user's hair and/or skin.

The substance which is applied to the hair and/or skin prior to use of the device may be applied in any suitable way. The substance may be a liquid, a transferable solid or plasma or any other kind of substance which can be applied to a surface. The substance may be applied by means of a pen, pencil or other similar means of application, such as a brush or a cotton bud or any other similar apparatus. FIG. 8 shows an exemplary pen 50 and an exemplary brush 51 for applying a substance to a user's hair and/or skin.

In one example, the substance is combined with shaving cream which the user applies to selected areas of the hair and/or skin. The shaving cream may therefore perform the conventional function of a shaving cream bringing hairs into a desired orientation for shaving and may also perform the additional function of indicating which areas of the hair and/or skin should be treated.

Alternatively, the substance may be applied by means of a stamping process, wherein a user applies the substance to a stamp and then pushes the stamp against their hair and/or skin to transfer the substance to their hair and/or skin. The stamp may be shaped to give a predetermined desired shape, such as a goatee beard, side burns or other facial hair arrangement. Alternatively, the user may apply the substance to their hair and/or skin using their hands, by using their fingers to spread the substance over selected areas of their hair and/or skin.

When applying the substance to the hair and/or skin a user may want to be able to see where the substance has been applied. For visible substances this is inherent, but for substances that are not visible top the naked human eye a specially adapted mirror or similar apparatus may be provided. For example, when using a substance only visible under ultraviolet light, the user may use a mirror having an ultraviolet light source so that the substance applied to the hair and/or skin is visible when using the mirror.

During application of the substance to the hair and/or skin, the user may wish to alter the position of the substance to correct mistakes or to change the desired arrangement. Therefore, the substance may be soluble in water and/or soap or any other substance so that the substance can be easily washed off. In one example, a correction pen or other means of application may be used to apply a correcting agent to the hair and/or skin of the user. The correcting agent will dissolve, remove or alter the substance applied to the hair and/or skin so that the sensor is not able to detect the substance in that area that has been corrected. This allows mistakes to be easily and accurately corrected by the user while applying the substance and afterwards. Moreover, once the device has been used on the skin and the desired hair and/or skin characteristics have been achieved, the substance may be washed off by the user.

The devices described with reference to FIGS. 2 to 7 relate to a device for cutting or shaving hair. However, it will be appreciated that the device as defined in the claims may be used for any method of treating hair or skin. For example, the device may be an epilator, shaver, trimmer, exfoliator, laser hair cutting device, moisturiser or any other powered device which interacts with the hair and/or skin of a user. Alternatively, the device may apply a substance such as colouring agent, shampoo, medical substance or any other substance to the hair or skin of the user.

The example devices described with reference to FIGS. 2 to 7 may be configured to disable the cutting units in dependence on the detection of the substance applied to the user's hair and/or skin. This may be achieved by disabling an actuator, such as a motor that drives a mechanical cutting part or a light source for a device which utilises an optical beam to sever hair. However, it will be appreciated that the controller may instead be configured to change a characteristic of the device in dependence on the detection of the substance applied to the user's hair and/or skin without disabling the device. For example, for a hair cutting device, the controller may be configured to change the cutting height of the cutting unit or change the power supplied to the actuator of the cutting unit. It will also be appreciated that the characteristic of the device which is changed depends on the purpose and function of the device and the invention as defined in the claims is not limited to any particular type of device for treating hair and/or skin. Therefore, the controller may be configured to alter any characteristic of the device in dependence on the detection of a substance applied to a user's hair and/or skin.

Furthermore, if the device has two or more cutting units then the controller may be configured to adjust an operating characteristic of the different cutting units in different ways. For example, one of the two or more cutting units may be stopped while simultaneously the cutting height of another cutting unit is altered. Therefore, it will be appreciated there are many ways in which the controller is able to adjust an operating characteristic of a device having multiple cutting units.

The devices described with reference to FIGS. 2 to 7 rely on detection of a substance applied to the user's hair and/or skin to alter an operating characteristic of the device so that different areas of hair and/or skin can be treated differently. One example device is a shaver which, by applying a substance to certain areas of a user's hair and/or skin, will only shave selected areas.

In further examples, the shaving device may have at least one sensor which is configured to detect the presence of longer hairs on the user's skin so that the device is able to shave around existing hair patterns. In these examples, the sensor on the device is configured to detect the boundary between longer hairs and shorter hairs, which is a detectable indicator that the controller recognises as a command to change an operating characteristic of the device.

In one example, the device may include at least one camera which is configured to detect the presence of longer hairs on the skin, in particular the boundary between longer hairs and shorter hairs, so that the cutting action can be altered at this boundary to continue shaving the shorter hairs and avoid shaving the longer hairs. The boundary between the longer hairs and shorter hairs on the skin acts as an indicator and, on detection of this indicator, the controller will change an operating characteristic of the device accordingly. This example device would allow a user to move the device over a pre-existing hair arrangement to shave the surrounding areas.

In this example, to detect the indicator of the boundary between longer hairs and short hairs, the sensor may be configured either to detect the presence of longer hairs on the skin or the interaction between longer hairs and the device, so that the operating characteristic of the device can be adjusted accordingly.

In one example, the sensor is a camera configured to optically identify longer hairs on the skin and the controller is configured to prevent those longer hairs from being shaved. Therefore, the cutting accuracy of the device along the boundary between any pre-existing hair pattern and the hairs which should be shaved will be improved.

In another example, the sensor to detect the indicator of the longer hairs is an acoustic sensor, such as a microphone, that detects the sound of the cutting units as they cut hairs. The sound of this cutting action will be different depending on the length of the hairs being cut and so the sensor is able to determine when the device has been moved onto a part of the skin with longer hairs and the cutting action can be altered accordingly.

In the above described examples, the controller may react to the detection of the longer hairs by stopping the cutting action in those areas so that only hairs around the longer hairs are shaved. Alternatively, a characteristic of the cutting action may be altered for the longer hairs. For example, the cutting height of the device may be altered so that the pre-existing longer hair is trimmed while the area surrounding the pre-existing longer hairs is shaved.

In another example, the sensor is configured to detect an indicator on the skin of the user that has been provided, by the user, without applying a substance. For example, a user may create a temporary visible mark on the skin using an optical technique or a gentle mechanical abrasion which will induce temporary coloration of the skin without the need to apply a substance to the skin. For example, a laser pen or light abrasive material may be used to cause temporary coloration on the skin. These marks may be identified by their colour, contrast against typical skin colour, or by their shape. These marks serve as an indicator that the sensor of the device will be able to detect which will allow the controller to change an operating characteristic of the device accordingly.

It will be appreciated that a device of the invention may be provided with a sensor configured to detect an indicator, mark or marking applied to or provided on the skin of a user. For example, as previously described, the indicator may be a substance applied to the skin, a change in the length of the hair on the skin, or a mark or any other indicator on the skin that may or may not require a substance to be applied. The device may comprise any combination of sensors configured to detect different indicators on the skin. The device may only be provided with a sensor that detects the presence of one indicator, for example a substance applied to the skin.

It will be appreciated that the term "comprising" does not exclude other units or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A device for cutting hair, comprising a treatment head which is placed against a user's skin during use of the device, the treatment head comprising a cutting unit configured to cut hair, the device further comprising an actuator configured to operate the cutting unit, and a controller configured to control the actuator, and a sensor, wherein the sensor is configured to detect a substance applied to a user's hair and/or skin, and wherein the controller is configured to control the actuator to change or stop an operation of the cutting unit in dependence on detection of said substance on said hair and/or skin by the sensor.

2. The device according to claim 1, wherein the controller is configured to control the actuator to change the operation of the cutting unit when the sensor detects said substance.

3. The device according to claim 1, wherein the controller is configured to control the actuator to stop the operation of the cutting unit when the sensor detects said substance.

4. The device according to claim 1, wherein the treatment head further comprises a guide face which is locatable against a user's skin during use of the device, the cutting unit extending through the guide face and the sensor arranged on the guide face, the device further comprising an additional actuator to adjust a distance between the cutting unit and the guide face, and wherein the controller is configured to control the additional actuator to change the distance between the cutting unit and the guide face in dependence on detection of said substance.

5. The device according to claim 1, further comprising an additional sensor is configured to detect the hair and/or skin of a user which is adjacent to the cutting unit when the device is in use.

6. The device according to claim 1, wherein the sensor is disposed relative to the cutting unit to detect said substance around at least a part of a periphery of the cutting unit.

7. The device according to claim 6, wherein the sensor is disposed adjacent the periphery of the cutting unit.

8. The device according to claim 6, further comprising a wave guide wherein the sensor is disposed on the waveguide.

9. The device according to claim 1, wherein the treatment head comprises one or more additional cutting units, and the device further comprising one or more additional actuators configured to operate the one or more additional cutting units.

10. The device according to claim 9, wherein the controller is configured to control the one or more additional actuators to change the operation of the cutting unit in dependence on the detection of said substance on said hair and/or skin by the sensor independent to an operation of the one or more additional cutting units.

11. The device according to claim 1, further comprising at least one additional sensor disposed to detect said substance on said user's hair and/or skin, wherein the sensor and the at least one additional sensor are arranged adjacent a periphery of the cutting unit, such that the sensor and the at least one additional sensor are arranged to detect the hair and/or skin of a user which is adjacent to the cutting unit in a plurality of directions when the device is in use.

12. The device according to claim 1, further comprising at least one additional sensor disposed to detect the user's hair and/or skin in an area between two cutting units.

13. The device according to claim 1, the device further comprising a feedback unit and an additional actuator to operate the feedback unit, wherein the controller is configured to control the additional actuator to change an operation of the feedback unit when the sensor detects said substance.

14. A system for cutting hair comprising a device for cutting hair according to claim 1 and an apparatus for applying a substance, which is detectable by the sensor of the device, to a user's hair and/or skin.

* * * * *